US006305540B1

(12) United States Patent
Crawford et al.

(10) Patent No.: US 6,305,540 B1
(45) Date of Patent: Oct. 23, 2001

(54) HOLSTER WITH VARIABLE DEPTH POCKET

(75) Inventors: Christopher D. Crawford, Tamarac; Eduardo Moralejo, Miami; Jennifer Kay Gatto, Coral Springs, all of FL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/574,009

(22) Filed: May 19, 2000

(51) Int. Cl.[7] ..... B65D 85/00
(52) U.S. Cl. ..... 206/320; 206/804
(58) Field of Search ..... 206/320, 804, 206/817, 305; 150/165

(56) References Cited

U.S. PATENT DOCUMENTS 1,206,124 * 11/1916 Meyers ..... 206/804
2,197,066 * 4/1940 Brody ..... 206/804
2,281,251 * 4/1942 Simmons ..... 206/804
3,395,787 * 8/1968 Plaskan ..... 206/804
3,589,505 * 6/1971 Burniski ..... 206/804
3,968,874 * 7/1976 Corey ..... 206/248
5,025,921 * 6/1991 Gasparaitis et al. ..... 206/320
5,092,459 * 3/1992 Uljanic et al. ..... 206/320
5,330,056 * 7/1994 de la Rocha ..... 206/581
5,819,944 * 10/1998 Terrasi ..... 206/534
5,967,321 * 10/1999 Sigl ..... 206/494

* cited by examiner

*Primary Examiner*—Shian Luong
(74) *Attorney, Agent, or Firm*—Frank M. Scutch, II

(57) ABSTRACT

A holster (100) includes an adjustable depth pocket (101) for receiving at least a portion of a portable radio (102) in the pocket (101). The portable radio (102) includes an interface, such as a user interface (120, 122), and the holster (100) includes access openings (124, 126). An adjustable false bottom (130) in the pocket (101) is adjustable to provide a variable depth in the pocket (101). When the portable radio (102) is received in the pocket (101) the user interface (120, 122) and the access openings (124, 126) are substantially aligned thereby the user interface (120, 122) is accessible from outside the holster (100) via the access openings (124, 126).

13 Claims, 5 Drawing Sheets

HOLSTER WITH VARIABLE DEPTH POCKET

TECHNICAL FIELD

This invention relates in general to the field of holsters and carrying cases, and more particularly to an adjustable depth holster or carrying case for carrying different size and/or dimension articles therein.

DESCRIPTION OF THE PRIOR ART

Holsters and carrying cases are commonly used for storing articles contained therein. The articles typically are contained in a pocket or enclosure within the holster or carrying case such that the article is protected from external hazards, and in certain applications the article is easily accessible from access opening in the holster or carrying case. For example, a user interface such as a keypad or a display may be accessible from outside of a holster or carrying case when the portable communication device is stored therein. Typically, the access opening or openings in a holster or carrying case are closely aligned with a user interface of a portable communication device that will be stored in the holster or carrying case. When a user inserts the portable communication device into the holster or carrying case the portable communication device is disposed on an inner bottom surface of the holster or carrying case such that the height of the portable communication device brings the user interface in close alignment with the access openings in the side wall of the holster or carrying case. The height of the user interface on the radio is closely matched with the depth of the pocket in the holster or carrying case.

It is common for portable communication devices to have variable dimensions according to certain features included with particular products. For example, a large battery pack may be included with a portable communication device such as to provide very long battery life and extended use. On the other hand, certain users may wish to have a smaller form factor and would appreciate a smaller battery pack being included with the portable communication device. In another example, a speaker may be larger for certain products than for others depending on an application. This variable size speaker may require a variable form factor and/or height dimension for a portable communication device.

Conventionally, a holster and/or carrying case is customized for each product embodiment. Accordingly, when two separate products have two different height dimensions and/or form factors a different holster and/or carrying case will be offered for each of the product embodiments. The only relevant difference between the two product embodiments with respect to the holster and/or carrying case is the height dimension and/or form factor that varies from product-to-product. Unfortunately, by customizing holster and/or carrying case to a particular embodiment of a product with a particular height dimension and/or form factor requires increased inventory of different holsters and/or carrying cases where the primary difference is in the depth of a pocket in the holster and/or carrying case. The additional inventory, regrettably, consumes additional costs in a manufacturing and marketing operation. Additionally, if a user of a portable communication device desires to alternate between two product form factors and/or height dimensions it would normally require utilizing two different holsters and/or carrying cases.

For example, a user of a portable communication device under certain application may require a large long life battery pack while in other applications may prefer a smaller lighter weight product to carry around. If a user would use only a single large holster or carrying case the smaller portable communication device would likely bounce around in the larger pocket, and may even spill out of a top because the device is not secured into the pocket. This dual device application would require the user to store two holsters and/or carrying cases for the two different height dimensions and/or form factor products, the primary difference being in the combination of the portable communication device with the large or smaller battery pack for a particular application. In this case, the user is burdened with the unnecessary additional cost of purchasing a second holster and/or carrying case for the alternative height dimension and/or form factor.

Therefore, there is a need to simplify and reduce the inventory of holsters and/or carrying cases that a manufacturing and/or marketing operation or a user must maintain to be able to carry product of different height dimension and/or form factor in a respective holster and/or carrying case.

DESCRIPTION OF THE PREFERRED EMBODIMENTS

This invention utilizes a new and novel holster and/or carrying case, (hereinafter generally referred to as a "holster"), to securely carry devices of different sizes in various dimensions and/or devices of different form factors. Generally, the holster is adjustable to securely accommodate a device in a pocket of the holster, according to a preferred embodiment of the present invention. As will be discussed in detail below, a preferred holster includes at least one adjustable strap that serves to provide a variable depth of a pocket in the holster to securely receive a device or article in the pocket.

Figure 1:
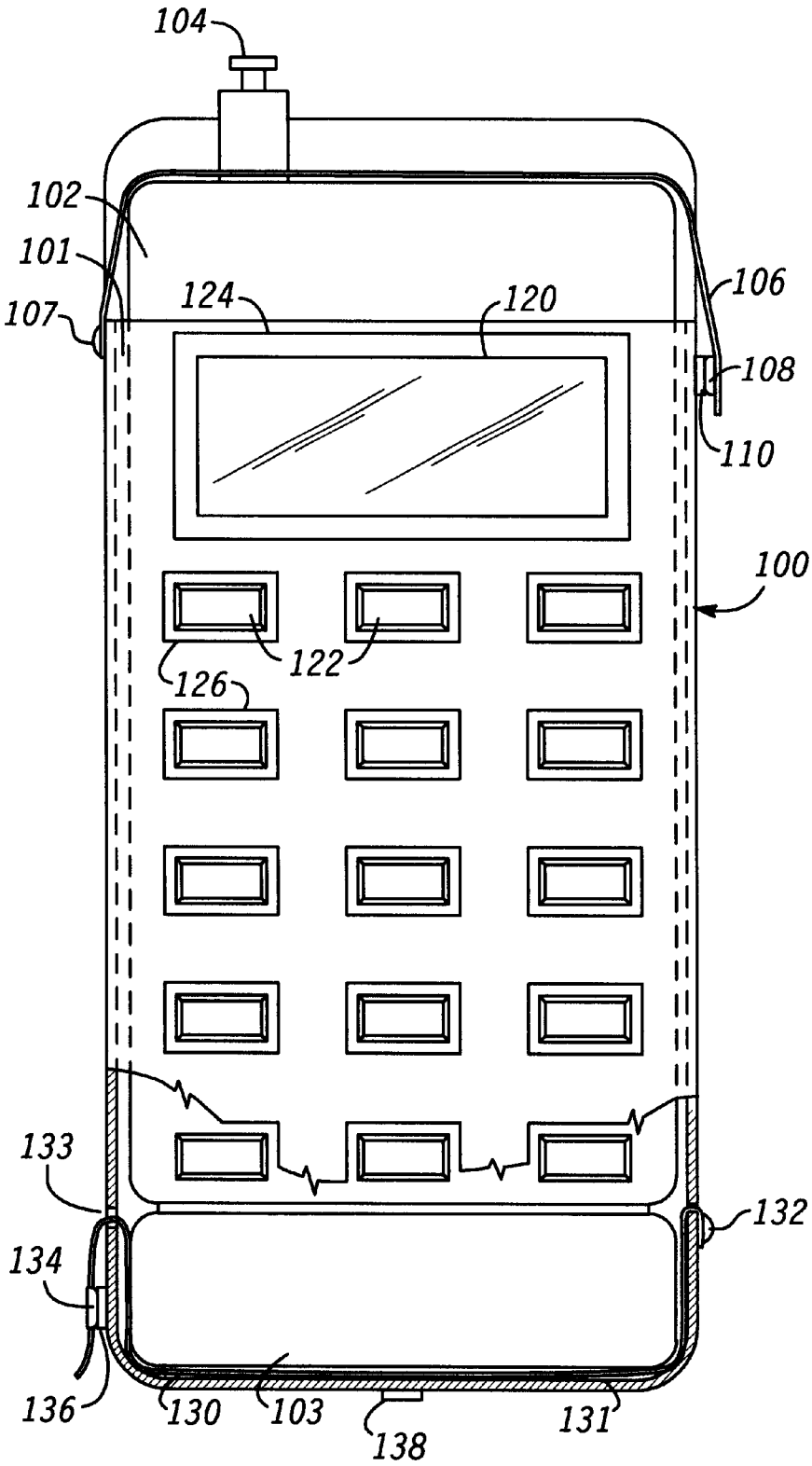
FIG. 1 is a front planar view of a portable communication device stored in a holster and/or carrying case, with a portion of the holster and/or carrying case being broken away to expose the inside features, according to a first preferred embodiment of the present invention.

Referring to FIG. 1, an exemplary holster 100 is illustrated according to a preferred embodiment of the present invention. A holster 100, in this example, contains a pocket 101 for carrying an object, such as a wireless communication device 102. In this example, the wireless communication device comprises a portable radio 102. The portable radio 103 includes a battery pack 103 for power source. The battery pack 103 is oversized, in this example, to provide extended battery life to the portable radio 102. The portable radio 102 includes an antenna 104 to facilitate wireless communication via the radio 102.

The portable radio 102, according to this example, is secured in the pocket 101 and additionally held in place by a strap 106 that extends across a top surface of the portable radio 102. The strap 106 is mechanically coupled to the holster 100 at a joint 107 about one end of the strap 106 and at a snap closure 108 about the other end of the strap 106. The snap closure 108 on the strap 106 mates to a snap catch 110 on the holster 100 to fasten the end of the strap 106 to the holster 100. The strap 106, of course, can be mechanically coupled to the holster 100 in other ways that are obvious to one of ordinary skill in the art in view of the discussion above. For example, hooks and eyelets or other types of fasteners can be used in place of the snap closure 108 and snap catch 110 in accordance with the preferred embodiment of the present invention. Also, a binding, stitching, or other form of fastening could be used about the other end of the strap 106 to mechanically couple that end to the holster 100. The strap 106 makes sure that an object, such as a portable radio 102 is securely received in the pocket 101, and that it does not bounce around loose in the pocket 101 possibly causing damage to the portable radio 102, discomfort to a wearer of the holster 100, and a possible opportunity to spill the portable radio 102 out of the top opening of the holster 100.

The portable radio 102 includes an interface, such as a user interface. The user interface, a shown, provides a keypad 122, e.g., a collection of keys or buttons, and a display 120, for a user of the portable radio 102 to communicate, such as to send and receive voice audio messages and view displayable information with the portable radio 102. The holster 100 includes a set of access openings 124, 126 that is substantially aligned with the user interface of the portable radio 102. Specifically, a first set of access openings 126 in the holster 100 are aligned with the keys of the keypad 122 on the portable radio 102 when the portable radio 102 is received in the pocket 101 of the holster 100. A separate access opening 124, in this example, is provided for the display 120 of the portable radio 102. When the portable radio 102 is located in the pocket 101 of the holster 100, the depth of the pocket 101 is substantially conforming with the height of the user interface of the radio 102 such that the set of access openings 124, 126, of the holster 100 is substantially aligned with the keys of the keypad 122 and the display 120. In this way, a user of the portable radio 102 can continue to use the portable radio 102 from the outside of the holster 100 while the radio 102 is contained in the pocket 101 of the holster 100.

According to a preferred embodiment of the present invention, a strap 130 is fitted inside the pocket 101 of the holster 100. One end of the strap 130 is secured to the holster 100 at a joint 132. This joint 132 preferably comprises a stitching-or binding to mechanically couple the strap 106 to the holster 100. However, other fastening or retaining mechanism may be used here, as may be obvious to one of ordinary skill in the art after the discussion presented above. A length of the strap 130 inside the pocket 101 of the holster 100 runs about the outer surface of the portable radio 102 device and a portion of the strap 130 exits through a slot 133 in the side wall of the holster 100. An end of the strap 106 is captured to the outer surface of the holster 100 by a fastener or retainer. In this example, the fastener or retainer comprises a snap closure 134 that mates to a snap catch 136 on the outer surface of the holster 100. However, other fastening or retaining mechanisms may be used to capture and hold in place the end of the strap 130 to the outer surface of the holster 100.

As can be seen in this example, the strap 130 inside the pocket 101 of the holster 100 extends on the bottom inner surface of the pocket 101 in the holster 100. The portable radio 102 rests on top of the strap 130 on the bottom of the holster 100. Therefore, the full depth of the pocket 101 in the holster 100 is available to receive a portable radio 102. The user interface of this portable radio 102 is located at a predetermined first height on the portable radio 102 relative to the bottom of the portable radio 102. A set of access openings 124, 126, in the holster 100 is located at a predetermined first depth in the pocket 101 in the holster 100. When the portable radio 102 is received in the pocket 101 in the holster 100, a shown, the user interface, such as the display 120 and the keypad 122, substantially aligns with the set of access openings 124, 126, in the holster 100. The user interface is therefore accessible by a user from outside the holster 100. The predetermined first height of the user interface on the portable radio 102 is substantially conforming to the predetermined first depth of the access openings 124, 126, in the pocket 101 in the holster 100.

The user interface of the portable radio 102 is accessible by a user through the access openings 124, 126, in the holster 100 such that a user of the portable radio 102 is able to manipulate the keypad 122, for example, and view the display 120. Additionally, other exemplary configurations of a portable radio 102 may include other interfaces that would be accessible via substantially aligned access openings in accordance with the preferred embodiment of the present invention. For example, an audio jack interface (not shown) on the portable radio 102 would be accessible for mating with and external microphone, ear piece, or headset plug (not shown) via an access opening (not shown) in the holster 100. As a second example, an infrared IrDA interface (not shown) on the portable radio 102 may be accessible through an access opening (not shown) in the holster 100 such that the portable radio 102 may be able to send and receive infrared data while being located in the pocket 101 in the holster 100. As a third example, a power input jack (not shown) on the portable radio 102 can be accessible by an external power source cable plug (not shown) via a substantially aligned access opening (not shown) in the pocket 101 in the holster 100. In this way, an external power source can provide power to a portable radio 102 even when the portable radio 102 is secured in the holster 100. This arrangement of access openings, as discussed above, can significantly increase the available functions and associated value added to a user when the portable radio 102 is inserted into the holster 100.

Figure 2:
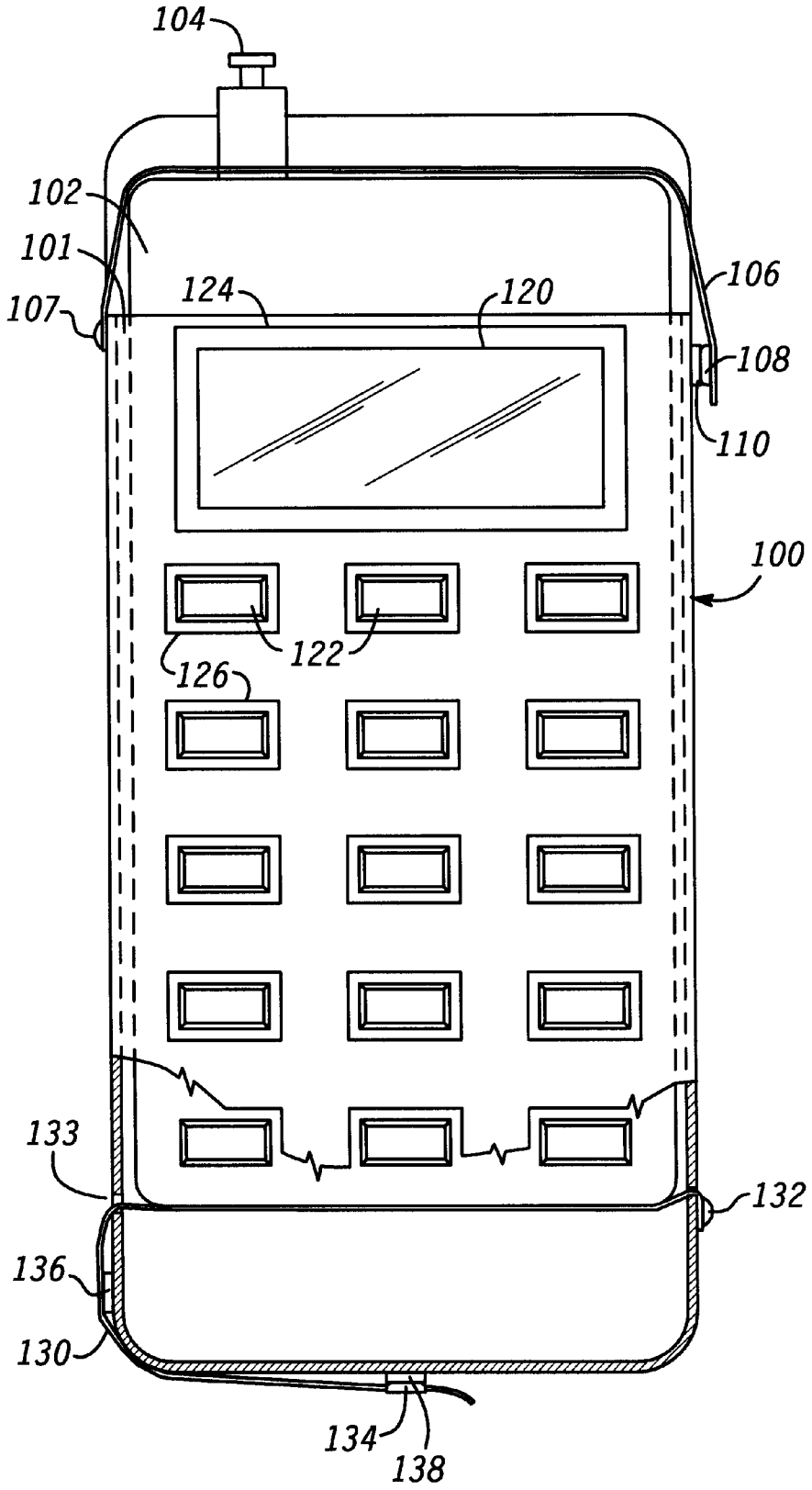
FIG. 2 is a front planar view of a portable communication device stored in an alternative arrangement of the holster and/or carrying case of FIG. 1 with a portion of the holster and/or carrying case being broken away to expose the inside features.

Referring to FIG. 2, a portable radio 102 is shown located in the holster 100 with the strap 130 forming a false bottom in the pocket 101 of the holster 100. In this example, the portable radio 102 has dimensions including a predetermined second height of an interface, such as a user interface 120, 122. Access openings, 124, 126, in the holster 100, substantially aligned with the user interface 120, 122 when the false bottom created by the strap 130 supports the portable radio 102 within the pocket 101 of the holster 100 as shown. The set of access openings 124, 126, in the holster 100 is located at a predetermined second depth in the pocket 101 in the holster 100, the predetermined second depth substantially conforming with the predetermined second height thereby substantially aligning the access openings, 124, 126, in the holster 100, with the user interface 120, 122. As shown in FIG. 2, the oversized battery pack 103 (see FIG.

1) has been removed in this configuration of the portable radio 102. This configuration, for example, may be desirable by a user when a lighter weight product (with a smaller and lighter battery power source) is more important than having the maximum extended battery life provided by the oversized battery pack 103.

In this example, the snap closure 134 about an end of the strap 130 is unsnapped from the first position snap catch 136 on the holster 100 and the end of the strap 130 with the snap closure 134 is extended to a second position snap catch 138 on the outer surface of the holster 100, such that when the snap closure 134 is snapped and secured to the snap catch 138 the stretched strap 130 creates a false bottom in the pocket 101 of the holster 100 as shown. This false bottom creates a predetermined second depth in the pocket 101 which is in conformance with a predetermined second height for an interface of a portable radio 102 device, as shown. The interface, such as a user interface 120, 122, on the portable radio 102 is substantially aligned to the access openings 124, 126, in the pocket 101 of the holster 100 such that the user interface 120, 122, is accessible by a user via the access openings 124, 126.

In this example, with the extended strap 130 creating a predetermined second depth "false bottom" in the pocket 101, besides a user interface, such as a keypad 122 and a display 120, the portable radio 102 may include other types of interfaces (not shown) that are accessible via other access openings (not shown) in the holster 100. Access openings (not shown) can be located in the holster 100 to provide external access to these other interfaces (not shown). For example, an external microphone or ear piece or head set may be plugged in, through an access opening, to an interface, such as audio jack, on the portable radio 102. Additionally, for example, an IrDA interface on the portable radio 102 may be communicatively coupled to an external IrDA equipped device that is enabled to communicate via IrDA data communication with the portable radio 102. As another example, an external power supply (not shown) may be coupled to the portable radio 102 via an access opening (not shown) in the holster 100, where the access opening has been substantially aligned with a power supply interface, such as a power jack, (not shown) on the portable radio 102. As discussed above, many different configurations of interfaces can be substantially aligned to access openings in the holster 100, according to preferred embodiments of the present invention. The ability to substantially align many different interfaces with access openings provides significant value to a user of the new and novel holster 100 and of at least one portable radio 102. The adjustable depth of the pocket 101, compare for example the two exemplary pocket depths of the pocket 101 shown in FIGS. 1 and 2, allows different portable radio 102 configurations and/or form factors to be used with the same holster 100 according to preferred embodiments of the present invention.

One end of the strap 130 has been shown coupled to an interior wall of the holster 100 with the other end of the strap 130 exiting at a slot in an opposing wall in the holster 100 and then being secured by a snap closure 134 to a catch, such as the snap catch 138, on an external surface of the holster 100. However, the adjustable false bottom mechanism for the pocket 101 of a holster 100 can vary significantly within the scope and spirit of the present invention, as will be discussed below with respect to a number of alternative preferred embodiments.

Figure 3:
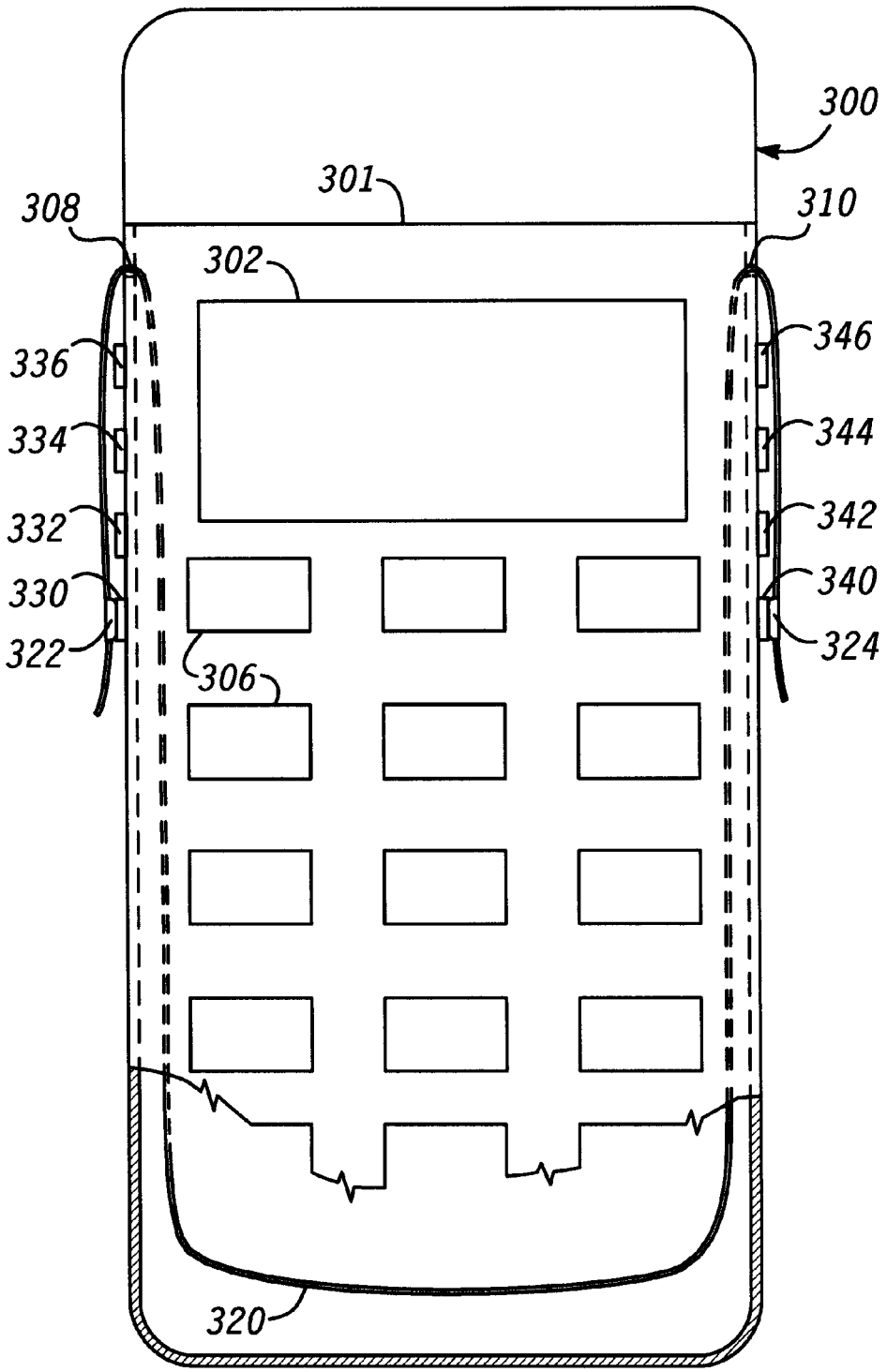
FIG. 3 is a front planar view of a holster and/or carrying case, with a portion of the holster and/or carrying case being broken away to expose the inside features, according to a second preferred embodiment of the present invention.

As illustrated in FIG. 3, a holster 300 includes a pocket 301 of adjustable depth for receiving at least a portion of an object such as a portable radio 102 (not shown in FIG. 3) in the pocket 301. A first end of a strap 320 exits via a first slot 308 in the holster 300 and a second end of the strap 320 exits via a second slot 310 in the holster 300. Each end of the strap 320 includes a snap closure 322, 324, as shown. A set of snap catches, such as four snap catches 330, 332, 334, 336, is located about an outer wall of the holster 300 to provide four snap positions for the snap closure 322 about the first end of the strap 320. Similarly, a set of snap catches, such as four snap catches 340, 342, 344, 346, is located about an outer wall of the holster 300 to provide four snap positions for the snap closure 324 about the second end of the strap 320. The four snap positions on the two outer walls of the holster 300, as shown, provide significant flexibility for the strap 320 to be progressively adjusted in the pocket 301 to provide a variety of predetermined depths for the pocket 301. These predetermined depths can be substantially conforming to a variety of predetermined heights of interfaces in different portable radios 102 or other objects that can be received in the pocket 301. In this way, by adjusting the depth of the pocket 301, for example, the access openings 302, 306, may be substantially aligned to a user interface 120, 122, on the portable radio 102 when the portable radio 102 is received in the pocket 301.

When the portable radio 102 is received in the pocket 301 in the holster 300, as shown, the user interface, such as the display 120 and the keypad 122, substantially aligns with the set of access openings 302, 306, in the holster 300. The user interface is therefore accessible by a user from outside the holster 300. By further adjusting the depth of the pocket 301, such as by repositioning the first snap closure 322 across the snap catches 330, 332, 334, 336, and the second snap closure 324 across the snap catches 340, 342, 344, 346, the pocket 301 may receive other objects, such as other portable radios 102 with varying dimensions while allowing interfaces in the portable radios 102 to be substantially aligned with a set of access openings in the holster 300. This is a significant advantage of the present invention.

Figure 4:
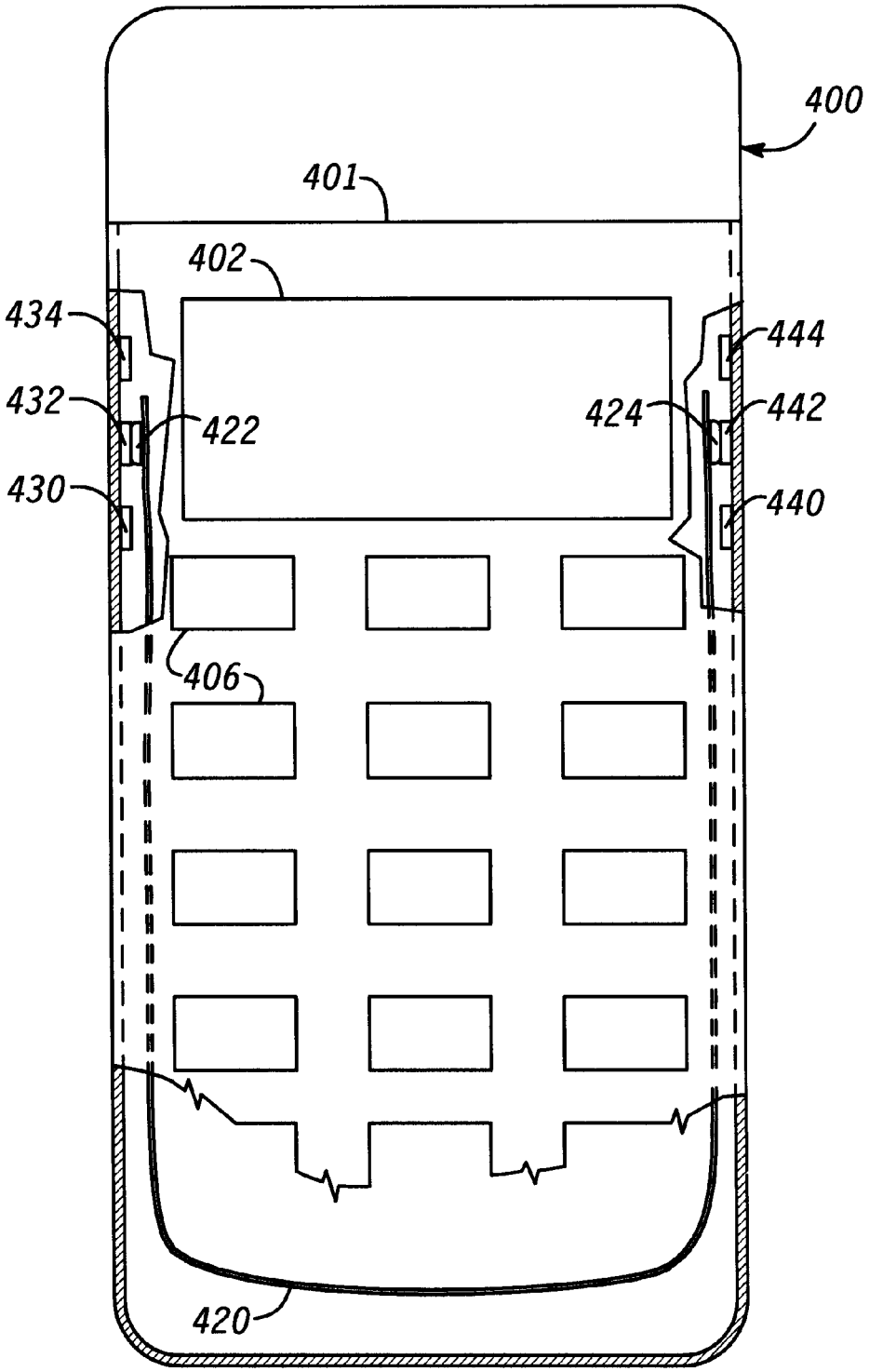
FIG. 4 is a front planar view of a holster and/or carrying case, with a portion of the holster and/or carrying case being broken away to expose the inside features, according to a third preferred embodiment of the present invention.

As illustrated in FIG. 4, according to an alternative preferred embodiment of the present invention, a holster 400 includes a pocket 401 having adjustable depth. A set of access openings 402, 406, in the holster 400 are substantially aligned to an interface (not shown) of an object, such as a portable radio 102, when the portable radio 102 is received in the pocket 401. The adjustable depth of the pocket 401 is provided by a strap 420 having a first snap closure 422 about one end of the strap 420 and a second snap closure 424 about a second end of the strap 420. The first snap closure 422 mates to one of first at least one snap catch 430, 432, 434, located inside the holster 400, and the second snap closure 424 mates to one of second at least one snap catch 440, 442, 444, located inside the holster 400. By repositioning the first snap closure 422 across the first at least one snap catch 430, 432, 434, and repositioning the second snap closure 424 across the second at least one snap catch 440, 442, 444, the false bottom and depth of the pocket 401 can be adjusted. The first and second at least one snap catch 430, 432, 434, 440, 442, 444, are preferably located in a recess or channel (not shown) portion in the wall of the holster 400. This recess or channel portion allows the snap closures and catches to snap securely while preventing a sliding object, such as a portable radio 102, being inserted in, or being removed from, the pocket 401 from being scratched or damaged by any protruding snap catch in the holster 400.

The variable depth of the pocket accommodates different dimensions for an object, such as a portable radio 102, to substantially align an interface in the portable radio 102 with access openings 402, 406, in the holster 400. By utilizing the snap features inside the holster 400, as discussed above, the exterior surfaces of the holster 400 can remain a smooth finish. This may be useful, in particular applications, to provide a smooth external surface of the holster 400 for a user to wear without concern that an externally located snap catch may damage another object coming in contact with the holster 400. Additionally, a user may prefer to wear an externally smooth holster 400, for example, to increase wearing comfort against user's skin, and to decrease the possibility of damaging clothes or other objects.

Figure 5:
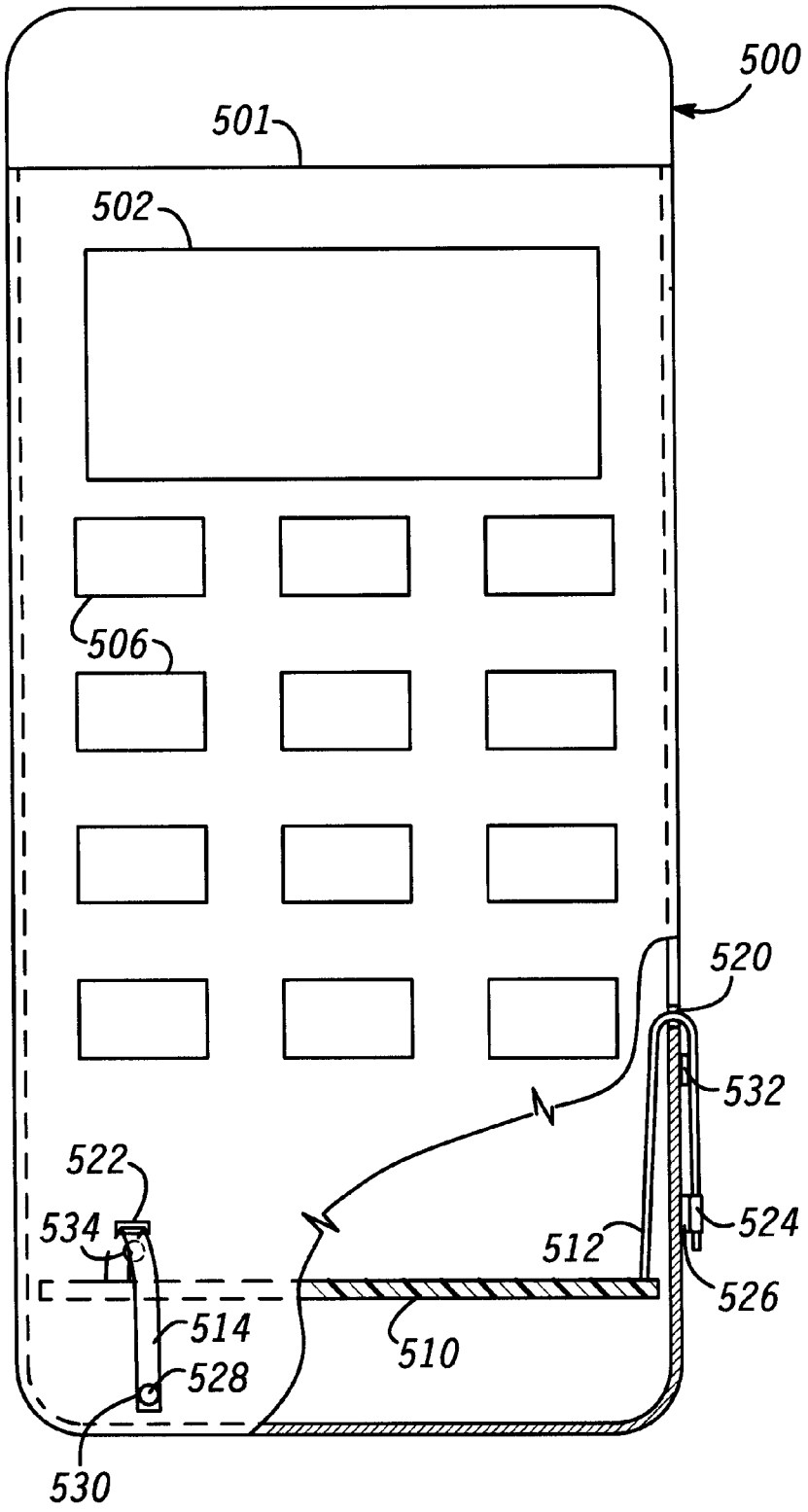
FIG. 5 is a front planar view of a holster and/or carrying case, with a portion of the holster and/or carrying case being broken away to expose the inside features, according to a fourth preferred embodiment of the present invention.

As shown in FIG. 5, according to an alternative preferred embodiment of the present invention, a holster 500 includes a pocket 501 having adjustable depth. A rigid, or semi-rigid, panel 510 provides a false bottom for the pocket 501. The false bottom is adjustable to vary the depth of the pocket 501. The panel 510 comprises a polycarbonate material. The panel 510 is fitted within the dimensions of the side walls of the pocket 501 in the holster 500 providing a false bottom inside the pocket 501 in the holster 500. The dimensions of the panel 510 preferably extend substantially to the dimensions of the inner walls of the pocket 501. However, the dimensions of the panel 510 can be significantly smaller than the dimensions of the inner walls of the pocket 501 while providing the false bottom for the pocket 501.

The panel 510, according to a preferred embodiment of the present invention, is mechanically coupled to at least one strap 512, 514, that can extend from the panel 510 upwardly in the pocket 501 and can be secured to an inner wall or to an outer wall of the holster 500. The at least one strap 512, 514, includes a snap closure 524, 528, about the end of the at least one strap 512, 514. A snap catch (not shown in FIG. 5) can be located at a desired depth along an inner wall of the pocket 501 in the holster 500. Alternatively, at least one snap catch 526, 532, 530, 534, is located on the outer wall of the holster 500. The at least one strap 512, 514, exits the holster 500 through respective at least one slot 520, 522. The snap closure 524, 528, about the end of the at least one strap 512, 514, mates with respective at least one snap catch 526, 532, 530, 534, to position the false bottom at a plurality of predetermined depths in the pocket 501. In this example, as shown in FIG. 5, a first strap 512 includes a snap closure 524 that can be snapped to one of two snap catches 526, 532, to provide two positions for varying the depth of the pocket 501. A second strap 514 similarly includes a snap closure 528 that can be snapped to one of two snap catches 530, 534, to provide two positions for varying the depth of the pocket 501. The first and second straps 512 and 514, as shown, are mechanically coupled to first and second dimensions of the panel 510 providing the adjustable false bottom in the pocket 501. The first and second dimensions are substantially perpendicular to each other.

When the end of the at least one strap 512, 514, is snapped and secured to the holster 500, the panel 510 forms a false bottom that can support, for example, the portable radio 102 at a predetermined depth in the pocket 501. When the portable radio 102 is received in the pocket 501, an interface (not shown in FIG. 5) in the portable radio 102 is substantially aligned with the access openings 502, 506. The interface is therefore accessible from outside the holster 500 via the access openings 502, 506.

Although the examples discussed above illustrate incremental steps of adjustment for the variable depth pocket 101 of a holster 100 it may be appreciated by those skilled in the art that a variable depth pocket 101 can be adjusted in very coarse steps or very fine steps, or alternatively, in a continuously variable adjustment that would allow the variable depth pocket 101 in a holster 100 to be used in many different applications. For example, a pressure catch feature that does not require mating to any particular predetermined position on a strap can be utilized on an outside wall of the holster 100 to provide continuously variable adjustment to the length of the strap along the outer wall and thereby adjusting continuously the inner depth of the pocket 101 according to the position of the false bottom.

By being able to adjust the depth of a pocket 101 to match different dimensions, form factors, and heights of particular interfaces of devices that are to be located in the pocket 101 of the holster 100, the present invention provides significant advantages. Specifically, an interface can be substantially aligned to access openings in the walls of the holster 100 for varying dimensions of products to be received in a pocket 101 in the holster 100. Therefore, a single holster 100 can conveniently serve different product dimensions, form factors, and heights for interfaces on the product to be used in combination with the holster 100. This is a significant advantage not available in any known prior art holster.

Although specific embodiments of the invention have been disclosed, it will be understood by those having ordinary skill in the art that changes can be made to the specific embodiments without departing from the spirit and scope of the invention. The scope of the invention is not to be restricted, therefore, to the specific embodiments, and it is intended that the appended claims cover any and all such applications, modifications, and embodiments within the scope of the present invention.

What is claimed is:

1. A holster comprising:

a pocket for receiving at least a portion of an electronic device in the pocket, the holster comprising at least one access opening associated with the pocket;

an adjustable false bottom in the pocket to provide an adjustable depth in the pocket, the adjustable false bottom being adjustable to provide a plurality of depths in the pocket relative to the at least one access opening, the plurality of depths substantially conforming to a respective plurality of heights of a plurality of interfaces of electronic devices, respectively, such that one of the plurality of interfaces is substantially aligned with the at least one access opening of the holster when an electronic device is received in the pocket, thereby the one interface being accessible from outside the holster via the at least one access opening; and wherein at least one strap mechanically coupled to the adjustable false bottom and to the holster to provide support for the adjustable false bottom in the pocket where the at least one strap is used to continuously adjust the relative position of the adjustable false bottom in the pocket and further wherein the at least one strap comprises first and second straps, and the first and second straps are mechanically coupled to the adjustable false bottom at first and second dimensions of the adjustable false bottom, respectively, and the first dimension is substantially perpendicular to the second dimension, and the first and second straps are mechanically coupled to the holster, thereby providing support for the adjustable false bottom in the pocket.

2. The holster of claim 1, wherein the electronic device is a portable radio and the interface comprises a user interface, and wherein the user interface is accessible by a user from outside the holster via the at least one access opening to operate the portable radio in the holster.

3. The holster of claim 1, further comprising:

at least one slot on at least one wall of the holster, the at least one strap being guided through the at least one slot, respectively, and being mechanically coupled to the adjustable false bottom in the pocket and to an outer at least one surface of the holster to provide support for the adjustable false bottom in the pocket.

4. The holster of claim 1, wherein an outer at least one surface of the holster comprises first and second fasteners located at first and second positions for mechanically coupling the at least one strap at the first and second positions and thereby positioning the adjustable false bottom in the pocket to a first and second depth, respectively.

5. The holster of claim 1, wherein the at least one strap comprises a single strap mechanically coupled to the adjustable false bottom and to the holster, and the adjustable false bottom comprises an at least semi-rigid panel, to provide support for the adjustable false bottom in the pocket.

6. A method comprising the steps of:

adjusting a location of a false bottom in a pocket of a holster thereby providing a depth for at least one access opening in the holster, the depth substantially conforming with a height of an interface of an electronic device such that when at least a portion of the electronic device is received in the pocket the interface is accessible from outside of the holster via the at least one access opening;

securing the false bottom to the holster to provide support for the electronic device in the pocket; and wherein the false bottom comprises at least one strap, and wherein the adjusting step comprises the step of positioning the at least one strap along a surface of the holster, and further wherein the securing step comprises the step of securing the at least one strap to the holster at the positioned location on the surface of the holster and providing a depth to the false bottom for at least one access opening in the holster where the at least one strap comprises first and second straps, and wherein the first and second straps are mechanically coupled to the adjustable false bottom at first and second dimensions of the adjustable false bottom, respectively, and wherein the first dimension is substantially perpendicular to the second dimension, and the first and second straps are mechanically coupled to the holster, thereby providing support for the adjustable false bottom in the pocket.

7. A holster for receiving a portable radio having a user interface, the holster comprising:

a pocket for receiving at least a portion of a portable radio in the pocket, the holster comprising at least one access opening associated with the pocket; and an adjustable false bottom in the pocket to provide an adjustable depth in the pocket, the adjustable false bottom being adjustable to provide a plurality of depths in the pocket relative to the at least one access opening, the plurality of depths substantially conforming to a respective plurality of heights of a plurality of interfaces of portable radios, respectively, such that one of the plurality of interfaces is substantially aligned with the at least one access opening of the holster when a portable radio is received in the pocket, thereby the one interface being accessible from outside the holster via the at least one access opening; and at least one strap mechanically coupled to the adjustable false bottom and to the holster to provide support for the adjustable false bottom in the pocket wherein the at least one strap comprises first and second straps, and wherein the first and second straps are mechanically coupled to the adjustable false bottom at first and second dimensions of the adjustable false bottom, respectively, and wherein the first dimension is substantially perpendicular to the second dimension, and the first and second straps are mechanically coupled to the holster, thereby providing support for the adjustable false bottom in the pocket.

8. The holster of claim 7, wherein the interface comprises a user interface, and wherein the user interface is accessible by a user from outside the holster via the at least one access opening to operate the portable radio in the holster.

9. The holster of claim 7, wherein the adjustable false bottom is continuously adjustable to a plurality of depths in the pocket.

10. The holster of claim 7, wherein the at least one strap continuously adjust the relative position of the adjustable false bottom in the pocket.

11. The holster of claim 7, further comprising:

at least one slot on at least one wall of the holster, the at least one strap being guided through the at least one slot, respectively, and being mechanically coupled to the adjustable false bottom in the pocket and to an outer at least one surface of the holster to provide support for the adjustable false bottom in the pocket.

12. The holster of claim 7, wherein the outer at least one surface of the holster comprises first and second fasteners located at first and second positions for mechanically coupling the at least one strap at the first and second positions and thereby positioning the adjustable false bottom in the pocket to a first and second depth, respectively.

13. The holster of claim 7, wherein the adjustable false bottom comprises an at least semi-rigid panel, to provide support for the adjustable false bottom in the pocket.

* * * * *